United States Patent [19]

Yoshida et al.

[11] 4,300,992

[45] Nov. 17, 1981

[54] ACTIVATED CATHODE

[75] Inventors: Hiroyuki Yoshida; Toshitada Akazawa; Tadayosi Haneda; Kenzi Watanabe, all of Koriyama, Japan

[73] Assignee: Hodogaya Chemical Co., Ltd., Tokyo, Japan

[21] Appl. No.: 683,241

[22] Filed: May 4, 1976

[30] Foreign Application Priority Data

May 12, 1975 [JP] Japan ..... 50-54664
Jul. 17, 1975 [JP] Japan ..... 50-86712

[51] Int. Cl.[3] ..... C25B 11/08; C25B 11/10; C25B 1/02

[52] U.S. Cl. ..... 204/242; 204/129; 204/290 R; 204/290 F; 204/291

[58] Field of Search ..... 204/290 F, 290 R, 291

[56] References Cited

U.S. PATENT DOCUMENTS

| | | | |
|---|---|---|---|
| 3,663,280 | 5/1972 | Lee | 427/126 |
| 3,677,815 | 7/1972 | Keith et al. | 204/290 F |
| 3,677,917 | 7/1972 | Martinsons | 204/99 |
| 3,706,644 | 12/1972 | Martinsons | 204/98 |
| 3,839,179 | 10/1974 | Koziol et al. | 204/219 |
| 3,915,838 | 10/1975 | Lee | 204/290 F |
| 3,929,608 | 12/1975 | Degueldre et al. | 204/290 F |
| 3,930,981 | 1/1976 | DeNora et al. | 204/256 |
| 4,049,532 | 9/1977 | Clerbois et al. | 204/290 F |

*Primary Examiner*—F. Edmundson
*Attorney, Agent, or Firm*—Cushman, Darby & Cushman

[57] ABSTRACT

Activated cathode for use in aqueous solution electrolysis comprises (a) a base plate made of a metal selected from the group consisting of titanium, tantalum, zirconium, niobium or an alloy essentially consisting of combination of those metals and (b) a metal oxide layer formed on the surface of the base plate, said metal oxide essentially consisting of an oxide of one or more metal elements selected from the group consisting of ruthenium, rhodium, palladium, osmium, iridium and platinum in the groups VIII—5 and VIII—6 of the periodic table and if necessary, (c) an oxide of one or more metal elements selected from the group consisting of calcium, magnesium, strontium, barium and zinc in the group II and chromium, molybdenum, tungsten, selenium and tellurium in the group VI.

12 Claims, No Drawings

ACTIVATED CATHODE

The present invention relates to a cathode for use in aqueous solution electrolysis in which a reaction of reducing hydrogen ions occurs.

More particularly, the present invention relates to an activated cathode for use in electrolysis which functions to prefer a reducing reaction of hydrogen ions on the surface of the cathode in electrolytic preparation of caustic alkali-chlorine (diaphragm method and ion exchanging method), electrolysis of aqueous hydrochloric acid solution, electrolysis of water, electrolytic oxidation and reduction of aqueous solution, diaphragm electrolysis of aqueous solution such as electrolytic polishing, and non-diaphragm electrolysis of aqueous alkali halide (electrolysis of sea water and electrolytic preparation of hypohalogenite, halogenates and perhalogenates).

Furthermore, the present invention relates to an activated cathode which can be able to control the reduction of hypochlorous ion which is simultaneously occurred with the reduction of hydrogen ion at the cathode in case of the production of an alkali chlorate such as sodium chlorate by non-diaphragm electrolysis of alkali chloride.

Heretofore, regarding an anode electrode used in the aqueous solution electrolysis, since a graphite anode included various defects, the development of a dimensionally stable electrode has been desired and remarkable progress has been made.

On the other hand, regarding a cathode electrode, iron or iron-based alloy (for example alloy of Fe and Ni, Cr, Mo, etc.) have been exclusively used. Since iron is inexpensive, shows a relatively good performance and is easy to fabricate, research and development activity for a new cathode material has been low and it has only been proposed with respect to water electrolysis to use a material made of nickel or nickel-base alloy, or iron-nickel or iron-chromium as a cathode, and to use graphite which is impregnated with salt of palladium, nickel or molybdenum as a composite electrode.

Now, considering the above cathode, iron has a relatively high overvoltage as a hydrogen ion reducing cathode, has an insufficient corrosion resistance and is consumed during use and hence contaminates the product. Particularly in the aqueous solution electrolysis of alkali chloride, corrosion of the iron cathode (particularly the corrosion by dissolved chlorine during no current feed) is a serious problem. Although nickel, iron-nickel or chromium plated cathode shows lower overvoltage than the iron cathode, it is still high from a practical standpoint and it exhibits poor corrosion resistance to the dissolved chlorine. Further, the metal impregnated graphite is hard to handle, shows a small mechanical strength and loses the effect of the impregnated metal in one or two week usage. Thus, each of the prior art cathodes has a significant shortcoming and requires a large electrolysis apparatus to reduce current density for economic reasons because it exhibits a large ratio of change of the overvoltage to the current density.

It has also been known that in the electrolytic preparation of hypohalogenite such as hypochlorite and halogenate such as chlorate, reducing reaction of hydrogen ions and reducing reaction of hypohalogenous ions such as $ClO^-$ occur and the latter reaction causes cathode current loss. In order to suppress such reduction reaction, chromate has been used as a reduction inhibiting agent. However, since the hazardous properties of the chromate have posed an environmental pollution problem, the present inventors have studied various reduction inhibiting agents which could take place of the chromate and have developed a method to suppress the reduction of hypochlorous acid ions at the cathode by adding one or more of calcium salt or magnesium salt and one or more of molybdenum salt, palladium salt, nickel salt, iron salt or vanadium salt to electrolytic bath or by depositing them to the electrode or impregnating them on the electrode. (See Japanese Laid-Open Patent Application No. 47287/74.) However, this method involves a drawback in that it is not always an effective way to deposit those salts to the surface of the prior art iron cathode by electrodeposition, for example, from the standpoint of precise measurement of deposition force.

The inventors have further studied the factors which caused the defects of the cathode from various respects and found that notwithstanding a common sense in modern chemistry art that a metal oxide cannot maintain the oxide state and the surface structure in a reducing environment at the cathode surface in the aqueous solution electrolysis, the metal oxide surface used in the anode shows a very high corrosion resistance as the cathode surface and it is highly active to the electrode reduction reaction of the hydrogen ions. The activated cathode of the present invention is based on the above finding.

The above activated cathode by itself can selectively conduct cathode reaction to compare with the prior art iron and graphite cathodes and can suppress the reduction of $ClO^-$ ions. Thus, by the simultaneous use of the reduction inhibiting agent, the effect of the reduction of $ClO^-$ ions can be further enhanced. However, the addition of the reduction inhibiting agent to an electrolytic bath or the deposition or impregnation of the agent to the cathode does not allow the activated cathode to fully exhibit its performance and leads to a risk of contaminating the product and the effluent. The inventors have further studied the resolution of those problems and finally completed the present invention.

An object of the present invention is to provide an activated cathode which is capable of preventing a cathode current loss due to the reducing reaction in the aqueous solution electrolysis, has a low overvoltage, a high corrosion resistance and a high mechanical strength and is easy to handle.

Another object of the present invention is to provide an activated cathode for use in the aqueous solution electrolysis which comprises (a) a base plate made of titanium, tantalum, zirconium, niobium or an alloy essentially consisting of combination of those metals and (b) a metal oxide layer formed thereon, which essentially consists of an oxide of one or more metal elements selected from the group consisting of ruthenium, rhodium, palladium, osmium, iridium and platinum in the groups VIII-5 and VIII-6 of the periodic table and optionally (c) an oxide of one or more metal elements selected from the group consisting of calcium, magnesium, strontium, barium and zinc in the group II of the periodic table and chromium, molybdenum, tungsten, selenium and tellurium in the group VI of the periodic table.

Other object of the present invention is to prevent the contamination of product and effluent by metal salt added to the electrolytic bath in the aqueous solution electrolysis.

As a base plate (a) above for the present electrode, titanium, zirconium, niobium or an alloy essentially consisting of the combination of those metals is used because of requirements of high conductivity, sufficiently high mechanical strength, ease of handling (ease of welding or the like) as well as high corrosion resistance in the aqueous solution electrolysis. The use of titanium and titanium-base alloy is advantageous from industrial standpoint. The base plate material is formed into an appropriate cathode shape.

The type of the present cathode may be (i) plate, (ii) sheet, (iii) plate or sheet having a number of apertures formed therein, (iv) mesh (including expanded metal), (v) grille, or (vi) box type or cylindrical body including mesh, grille or punched metal which is welded to plate, pipe, rod or rib.

The layer of the metal oxide (b) above of the metal elements in the group VIII of the periodic table which is formed on the electrode base plate should functions to reduce the cathode potential, should be active to the reduction of $H^+$, have a high corrosion resistance (to the electrode reduction reaction and to oxidizing solution during no current feed), have a high wear resistance (to liquid flow and to friction by suspended particles) and have a high conductivity. This metal oxide is selected from the oxides of ruthenium, rhodium, palladium, osmium, iridium and platinum. The metal oxides may be used singly, or as an oxide of the combination of those metals, or optionally as an oxide of the combination with other metals, particularly those metals (c) above in the groups II or VI, and the oxide may be formed in a single layer or in a multi-layer.

The layer of the metal oxide (c) may be applied on only one surface of the electrode base metal and a layer of a metal oxide forming an anode surface may be applied on the opposite surface. Therefore, it should be understood that the term "cathode" herein used involves a cathode surface in a bipolar (composite) electrode.

While a conventional method used in an anode surface treatment can be applied to form the layer of the metal oxide (b) forming the cathode surface on the surface of the electrode base plate, it is a common method to apply solution of the salt of the above metal on the surface of the electrode base plate, heat the base plate to form the metal oxide and affix it to the electrode base material.

The layer of the oxide (c) above of the metal elements in the groups II and VI of the periodic table has the ability of preventing the reduction of $ClO^-$ and consists of an oxide of one or more metal elements selected from the group consisting of calcium, magnesium, strontium, barium, zinc (group II) and chromium, molybdenum, tungsten, selenium, tellurium (group VI).

While the layer of the oxide (c) or the layer preventing the reduction of $ClO^-$ (hereinafter referred to as a reduction inhibiting layer) is generally formed on the layer of the oxide (b) or the activated layer, the activated layer and the reduction inhibiting layer may be formed as an integrated layer on the base plate, as stated above.

Although a conventional method used in the anode surface treatment may be applied to form the activated layer (b) and the reduction inhibiting layer (c) on the surface of the cathode base plate (a), it is a common method to apply solution of the salt of the metals (b) on the surface of the cathode base plate, heating the base plate to form the metal oxide and affix it on the cathode base plate to form the activated layer, then applying a solution of the salt of the metals (c) on the activated layer, heating the base plate to form the metal oxide of the metals (c) and affix it on the activated layer to form the reduction inhibiting layer for completing the desired cathode.

Specifically, the electrode base material is subjected to sand-blasting or etching to remove an oxide film on the base plate and to impart roughness on the surface to facilitate coating by the metal salt solution. Etching is carried out by dipping the base plate in 10% aqueous solution of oxalic acid as etching agent for 1–50 hours, preferably more than 3 hours, and then dipping it in degassed water for washing. This step may be repeated several times as required. The etching agent is not critical so long as it is adapted to the particular metal or alloy forming the base plate and it may be an aqueous HF solution, an aqueous HF—glycerol solution, an aqueous HF—$HNO_3$ solution, an aqueous HF—$HNO_3$-glycerol solution or an aqueous HF—$HNO_3$—$H_2O_2$ solution.

Inorganic or organic salt of the metal element which produces the metal oxide forming the activated layer (b) and the reduction inhibiting layer (c) is mixed, singly or in combination, with water, acid or organic solvent at a concentration equivalent to metal atomic concentration of 0.05—2 gr. atoms/l, preferably 0.1–0.5 gr. atoms/l, and dissolved therein. The organic solvent used may be dimethyl formamide, 2-ethyl hexanol, lavender oil or aniseed oil, or any other solvent which can dissolve the above metal salts.

Coating of the solution of the metal salt for the metal (b) onto the surface of the etched cathode base plate is effected by heating the base metal to 50°–500° C., preferably 100°–300° C. in a heating oven or on a hot plate and maintain the above temperature for applying the metal salt solution. Applying means may be spray coating, brush coating or by dipping the base plate heated to the above temperature into a boiled metal salt solution, in which case care should be taken to prevent substantial temperature fall of the base plate during the application (preferably, the temperature fall should be within 10 degrees in centigrade). After the completion of the application, the base plate is dried at the same temperature for 5–10 hours. The above coating process is repeated two or more times, preferably 2–5 times.

After the completion of the coating process, the base plate is immediately heated in an oxygen atmosphere (usually in air) at 300°–1000° C., preferably 400°–700° C. for 10 minutes–48 hours and then left for cooling. During this process, the thickness of the metal oxide layer should reach 0.5–50 microns, preferably 1–10 microns. It is desirable to repeat the coating-heating process at least twice.

Where a layer of two or more metal oxides is to be formed, mixed solution of two or more metal salts may be coated and then heated, or alternatively one metal salt solution is coated and heated and then other metal salt solution is coated and heated and the above steps are further effected alternately. The latter method is advantageous in enhnacing the adherence of the activated metal oxide on the base plate.

The reduction inhibiting layer (c) is formed as a composite layer on the cathode base metal on which the activated layer has been formed by applying the same coating-heating process for the metal oxide (b) to the coating-heating process for the solution of the metal salt (c). When the activated layer and the reduction inhibiting layer are to be formed as an integral layer, mixed solution of the metal salts (b) and (c) may be used in a similar process.

It is considered that the metal oxide layer of the cathode forms with the base metal such as titanium an eutectic mixture of a solid solution of the oxides of the both and affixes to the base metal.

It is, therefore, considered that in forming a chromium oxide layer, unlike $Cr(OH)_3$ layer or $Cr_2O_3$ layer (which functions to prevent the reduction of $ClO^-$) on the cathode surface, which is expected to exist in a prior art method using chromium salt, the reduction inhibiting layer in the present invention is cathodically inactive and it functions as a sort of ion selective transmission layer which allows the transmission of $H^+$ but inhibits the transmission of $ClO^-$.

When the cathode of the present invention is used in an electrolytic cell, it may be electrically connected with a body of the electrolytic cell structure as a part thereof, or it may be electrically isolated from the electrolytic cell and disposed in opposite to an anode.

It is particularly advantageous to use the cathode of the present invention as a bipolar electrode of a bipolar type cell. In the prior art bipolar electrode, it is necessary to use a Ti-Fe clad or to make Ti-Fe connection at a portion where no cell liquid exists for allowing a current to pass therethrough. Furthermore, when the cathode and the anode are manufactured by different materials, corrosion occurs at the junction thereof, and contact resistance increases, the construction becomes complex and the easiness of handling is damaged. According to the present invention, since the same material can be used for the cathode and the anode, the above drawbacks have been completely overcome and a composite electrode of very small thickness can be manufactured, which in turn enables the realization of a very compact electrolytic cell.

When the cathode surface metal oxide layer is formed as the bipolar electrode, there is further advantage in the manufacture in that the formation and/or heating of the metal oxide coating can be effected under the same condition as that for the anode surface metal oxide layer.

The characteristics of the present activated cathode are given below:

(A) Since it has a very small overvoltage, a power consumption can be reduced and a cathode current density can be increased correspondingly. As a result, an electrolytic cell having a large production unit can be manufactured.

(B) Since the reducing reaction occurs on the surface of the metal oxide layer, the body of the electrode base plate is protected and the durability thereof is semi-permanent. When the activity of the metal oxide on the surface of the cathode is consumed, the base plate may be coated again.

(C) The cathode reduction reaction of the dissolved chlorine (hypochlorous acid ion) is low, and the selectivity to the desired reaction is high (high current efficiency).

(D) High corrosion resistance, high durability as a cathode and easy to maintain.

(E) Since a potential gradient for current is small, a large current can be passed, which enables the realization of a compact electrolytic cell having a small floor space.

(F) When a bipolar electrode is to be manufactured, the cathode can be heat treated simultaneously with the anode under the same condition. This is very convenient in manufacturing the composite electrode.

The advantages of the present cathode in which there is formed on the metal oxide layer (b) and optionally a further oxide layer (c) of other metal, particularly the metals in the groups II or VI of the periodic table, are given below:

(G) The reduction of hypochlorous acid ions is substantially prevented without requiring the addition of harmful chromic acid ions to the electrolytic bath.

(H) Accordingly, the process of eliminating the chromic acid ions in the product, salt-water mud, and effluent can be eliminated.

(I) The cathode overvoltage is very low to compare with that attainable by a prior art iron cathode-chromic acid ion addition method or other methods.

(J) High corrosion resistance and high durability. It has been recognized that the metal oxide in the group II can provide longer durability and superior function of preventing the reduction of $ClO^-$ than the metal oxide in the group VI.

The present invention is illustrated below in detail with reference to Examples.

EXAMPLE 1 (Electrolytic preparation of sodium chlorate)

1. Manufacture of cathode

A number of cylindrical chips of titanium having bottom area of 0.8 $cm^2$ were boiled in 10% aqueous solution of oxalic acid for five hours, and then boiled and washed in boiling degassed distilled water for 30 minutes. The above step was repeated three times. The resulting etched titanium chips were then heated to 250° C. in an electric furnace and removed therefrom. Metal salt solution was rapidly applied on the chips by brush while care was being paid to prevent the temperature fall. The chips were immediately in the dry state. This step was repeated three times. Then, the temperature of the electric furnace was elevated, and the chips were heated for two hours. Thereafter, they were left for cooling to complete the cathodes.

The metal salt solution used in the present process was prepared such that the metal salt concentration of the solution was equivalent to metal concentration of 0.25 gr. atoms/l. The metal salts and solvents used as well as heating temperatures are listed in Table 1.

TABLE 1

| Exp. No. | Base Plate | Metal Salt | Solvent | Heating Temp. °C. | Remark |
|---|---|---|---|---|---|
| 1 | Iron | — | — | — | |
| 2 | Titanium | — | — | 450° C. after etching | |
| 3 | " | $RuCl_3 . 3H_2O$ | DMF | 450° C. | |
| 4 | " | $RhCl_3 . 3H_2O$ | DMF | 450° C. | |
| 5 | " | $PdCl_2$ | DMF + lavendor oil | 600° C. | Same temperature for mixed deposition |
| 6 | " | $OsO_4$ | aqueous solution of HCl + DMF | 450° C. | |
| 7 | " | $IrCl_3$ | DMF | 450° C. | |
| 8 | " | $H_2PtCl_6 . 6H_2O$ | DMF | 450° C. | |

In the table, DMF stands for dimethyl formamide and the experiments Nos. 1 and 2 are shown as comparative examples.

2. Using the cathodes thus manufactured, the relations between the cathode current density and the cathode potential in sodium chlorate electrolyte composition were measured.

In measuring the cathode potential, the activated cathode chip manufactured in 1. above was incorporated in a rotary electrode and a platinum counterelectrode was used. The rotation speed was set at 1000 r.p.m. and the cathode potential was measured while eliminating the influence of the diffusion layer.

Electrolysis conditions were; electrolyte composition: NaCl 196 g/l, $NaClO_3$ 233 g/l, $CrO_4^-$ – 1.6 g/l, $ClO^-$ 2.0 g/l, pH: 8.5 and temperature: 30° C.

Prepolarization of the cathode was conducted in the above electrolyte composition at a current density of 25 A/dm$^2$, for 72 hours at 30° C.

After the prepolarization, the change of the cathode potential to the cathode current density was measured. The result of the measurement is shown in Table 2. The experiment numbers in the Table 2 represents the experiments using the cathodes of corresponding experiment numbers in the Table 1.

TABLE 2

| Exp. No. | Base Plate | Metal of Oxide | Cathode Current Density (A/dm$^2$) 10 | 20 | 30 |
|---|---|---|---|---|---|
| 1 | Fe | — | $-1.30^V$ | $-1.48^V$ | $-1.62^V$ |
| 2 | Ti | — | −1.86 | −1.97 | −2.08 |
| 3 | " | Ru | −1.19 | −1.26 | −1.33 |
| 4 | " | Rh | −1.18 | −1.25 | −1.32 |
| 5 | " | Pd | −1.23 | −1.34 | −1.43 |
| 6 | " | Os | −1.34 | −1.50 | −1.61 |
| 7 | " | Ir | −1.24 | −1.36 | −1.48 |
| 8 | " | Pt | −1.26 | −1.38 | −1.48 |

The effect of the present cathode will be apparent from the Table 2. It should be particularly noted that the titanium surface was highly activated and that higher cathode current density is obtained than by an iron cathode.

EXAMPLE 2

In plate of single metal oxide in the Example 1, mixed metal oxides were used to coat the cathodes according to the method described in the Example 1. The mixing ratio of the metal oxide in the mixed metal oxide was 1:1 (in the equivalent metal ratio represented by gr.atoms). This is shown in Table 3. Using those cathodes, the cathode potentials were measured at a cathode current density of 25 A/dm$^2$ and at a temperature of 30° C. in accordance with 2 of the Example 1. The result of the measurement is also shown in the Table 3.

TABLE 3

| Exp. No. | Mixed Oxide Metal | Cathode Potential** V(vs.s.c.e.) | Exp. No. | Mixed Oxide Metal | Cathode Potential** V(vs.s.c.e.) |
|---|---|---|---|---|---|
| 1 | — | −1.66 | 13 | Rh—Os | −1.35 |
| 2 | — | −2.07 | 14 | Rh—Ir* | −1.28 |
| 9 | Ru—Rh | −1.28 | 15 | Pd—Os | −1.54 |
| 10 | Ru—Pd | −1.27 | 16 | Pd—Pt* | −1.31 |
| 11 | Ru—Pt | −1.33 | 17 | Os—Pt | −1.49 |

TABLE 3-continued

| Exp. No. | Mixed Oxide Metal | Cathode Potential** V(vs.s.c.e.) | Exp. No. | Mixed Oxide Metal | Cathode Potential** V(vs.s.c.e.) |
|---|---|---|---|---|---|
| 12 | Rh—Pd | −1.28 | 18 | Ir—Pt | −1.57 |

*Those mixed oxide metals represent the cathodes manufacture by two-step coating-heating process in the sequence of beginning from the latter metal (Ir or Pt) to the former metal (Rh or Pd).

**Those cathode potential (V) represent potential difference from a saturated colomel reference electrode.

It is apparent from the Tables 2 and 3 that Rh and Ru oxides and mixed oxides of those with other metal, particularly Pd are particularly advantageous and that mixed oxide of three or more metals or combination with other metal oxide is also advantageous.

EXAMPLE 3 (Durability of cathode in electrolytic preparation of sodium chlorate)

1. Manufacture of cathode

A titanium plate of 50 mm × 50 mm (0.25 dm$^2$) × 3 mm thickness was prepared, and ruthenium oxide layer was formed on one surface of the titanium plate according to the method of 1. in the Example 1, and Rh-Ru-Sb mixed oxide layer (gram atom ratio of equivalent metal atoms being 1:2:1) was formed on the other surface simultaneously with the formation of the cathode surface for manufacturing a composite electrode. The anode surface was formed under the same conditions of etching, deposition and heating as those for the cathode surface except that the metal salt solution was prepared by dissolving $RhCl_3.3H_2O$ and $RuCl_3.3H_2O$ in dimethyl formamide and diluting $SbCl_3$ with 2-ethyl hexanol and mixing the both solutions.

Seven such composite electrodes and a pair of monoelectrodes (cathode and anode) were combined to form a bipolar electrode type electrolytic cell.

2. Using the above electrolytic cell, sodium chlorate was manufactured. Electrolysis conditions were; electrolyte composition NaCl 191–206 g/l, $NaClO_3$ 234–245 g/l, $CrO_4^-$ – 0.9–0.7 g/l, pH:6.2–6.7, temperature: 45° C., current: 6.25 amperes (25 A/dm$^2$), interelectrode distance: 3 mm, and under continuous operation. The result is shown in Table 4.

The experiment was conducted while washing the electrode surface for every 30 days after the activation by HCl aqueous solution. The figures in prentheses in the Table show the data for HCl washing.

In the Table 4, the cause of voltage rise with the elapse of time is the deposition of scale onto the cathode surface. The comparison of the result to an iron cathode electrolytic cell under the same conditions shows that the voltage is less by 0.28–0.3 volts, and the amount of power required for production of the product is less by 1,000–1,200 KW/$NaClO_3$ ton. After 150 day operation, there was no appreciable change in the cathode activity. Through the repetition of no current feed state in the $NaClO_3$ electrolytic cell, washing by HCl aqueous solution and current feed state, which is the most severe condition among the aqueous solution electrolysis, it was proved that the cathode had sufficiently high durability.

TABLE 4

| Number of days after activation | Voltage per cell (V) | Voltage after washing by HCl aqueous solution on electrode surface (V) | Current Efficiency (%) | Amount of D.C. power required for production of the product (KWH/$NaClO_3$ ton) |
|---|---|---|---|---|
| 0 | 2.69 | | 94.2 | 4310 |
| 5 | 2.71 | | 93.5 | 4350 |
| 15 | 2.78 | | 91.3 | 4600 |
| 30 | 2.95 | (2.68) | 92.1 (92.7) | 4840 (4370) |
| 60 | 3.06 | (2.73) | 94.5 (93.0) | 4890 (4430) |
| 90 | 3.01 | (2.74) | 93.9 (94.2) | 4840 (4390) |
| 120 | 3.00 | (2.70) | 94.0 (92.8) | 4820 (4400) |
| 150 | 3.04 | (2.71) | 91.7 (92.6) | 5010 (4420) |
| Average | 2.83 | | 93.0 | 4590 |

EXAMPLE 4 (Cathode current loss in electrolytic preparation of sodium chlorate)

Similar cathode to that of 1. in the Example 1 was prepared under the same electrolysis conditions except that $CrO_4$— —as cathode reduction inhibiting agent for ClO— was not included. The prepolarization was also conducted in a similar way. The cathode current loss under those electrolysis conditions was measured. It was obtained by measuring critical current to the cathode reduction of Cl— and calculating current ratio thereof to operating current (25 A/$dm^2$). The relation between the ClO— concentration and the cathode current loss is shown in Table 5.

TABLE 5

| Exp. No. | Base Plate | Metal of Oxide | ClO⁻ Concentration (g/l) 0.5 | 1.0 | 1.5 | 2.0 |
|---|---|---|---|---|---|---|
| 1 | Fe | — | 4.4% | 8.3% | 12.4% | 16.2% |
| 3 | Ti | Ru | 3.0 | 6.3 | 9.5 | 12.7 |
| 4 | Ti | Rh | 4.0 | 7.5 | 11.0 | 14.7 |
| 19 | Graphite | — | 7.2 | 15.0 | 22.8 | 30.0 |

In the Table 5, the experiments Nos. 1, 3 and 4 use the cathodes in the experiments Nos. 1, 3 and 4 in the Table 1, and the experiment No. 19 uses graphite cathode as a comparative example. The Table 5 shows that Rh and Ru oxide activated cathodes exhibit smaller cathode current loss than graphite and iron cathodes, and the former has a function of selecting the cathode reaction and preventing the reduction of ClO−.

EXAMPLE 5 (Electrolytic preparation of caustic soda)

A cathode prepared in accordance with 1. in the Example 1 and the Example 2 was used. The composition of the caustic soda was NaOH 141 g/l and NaCl 187 g/l, and the temperature was 30° C. A glass filter was used as a diaphragm and the prepolarization was conducted in the same electrolytic composition. In other aspects, the same procedures as in the Example 1 were used. The relations between the cathode current density and the cathode potential in the electrolyses using various cathodes are shown in Table 6. The experiment numbers in the Table 6 represent the electrolysis experiments that used the cathodes in the corresponding experiment numbers shown in the Tables 1 and 3.

TABLE 6

| Exp. No. | Base Plate | Metal of Oxide | Cathode Current Density (A/$dm^2$) 10 | 20 | 30 | 40 |
|---|---|---|---|---|---|---|
| 1 | Fe | — | $-1.54^V$ | $-1.59^V$ | $-1.63^V$ | $-1.66^V$ |
| 2 | Ti | — | −1.80 | −1.85 | −1.89 | −1.92 |

TABLE 6-continued

| Exp. No. | Base Plate | Metal of Oxide | Cathode Current Density (A/$dm^2$) 10 | 20 | 30 | 40 |
|---|---|---|---|---|---|---|
| 3 | " | Ru | −1.20 | −1.23 | −1.26 | −1.28 |
| 4 | " | Rh | −1.22 | −1.26 | −1.31 | −1.35 |
| 5 | " | Pd | −1.42 | −1.49 | −1.54 | −1.58 |
| 8 | " | Pt | −1.22 | −1.26 | −1.31 | −1.35 |
| 10 | " | Ru—Pd | −1.17 | −1.19 | −1.22 | −1.24 |
| 20 | " | Ru—Ir | −1.22 | −1.25 | −1.28 | −1.32 |
| 11 | " | Ru—Pt | −1.20 | −1.23 | −1.26 | −1.28 |
| 12 | " | Rh—Pd | −1.18 | −1.20 | −1.23 | −1.26 |
| 13 | " | Rh—Os | −1.24 | −1.30 | −1.35 | −1.40 |
| 21 | " | Pd—Ir | −1.26 | −1.32 | −1.38 | −1.44 |

The experiments Nos. 20 and 21 represent the cathodes manufactured in the same manner as in the Example 2 except that different combinations of metals in the mixed metal oxides are used.

It is apparent from the Table 6 the cathodes of the present invention exhibit for superior characteristic in the electrolytic preparation of caustic soda, like in the electrolytic preparation of sodium chlorate in the Example 1.

EXAMPLE 6

1. Manufacture of cathode

A number of cylindrical chips of titanium having effective area of 0.8 $cm^2$ were boiled in boiling 10% aqueous solution of oxalic acid for 5 hours, and then boiled and washed in boiling, degassed distilled water for 30 minutes. This step was repeated three times. The resulting etched titanium chips were heated to 250° C. in an electric furnace and then removed therefrom, and solution of metal salt forming the activated layer was promptly applied thereon by brush while paying attention to the temperature fall. The chips were immediately in dry state. They were heated in the electric furnace at 450° C. for two hours. This step was repeated five times to complete the activated layer.

The metal salt solution used was prepared by dissolving $RuCl_3.3H_2O$ and $RhCl_3.3H_2O$ in dimethyl formamide (DMF) to present equivalent metal concentration of 0.25 gr. atoms/l respectively, and mixing the above solutions at the ratio of 1:1.

In order to form the ClO− reduction inhibit layer, the metal salt solutions shown in the Table 7 were applied on the cathodes which had the above activated layers thereon and which had been heated to 250° C. The cathodes were then heated in the electric furnace to 450° C. for two hours. This step was repeated four times. The metal salt solutions shown in the Table 7 were prepared by dissolving the listed metal salts in the listed solvents such that equivalent metal concentration of 0.25 gr.atoms/1 results.

2. Using the above cathodes, the cathode potential and the cathode current loss in the electrolyte composition for preparing sodium chlorate were measured.

In measuring the cathode potential, the cathode chip manufactured by 1. above was incorporated in a rotary electrode to form a cathode with a platinum counter-electrode being used. The rotation speed was set to 1000 r.p.m. and the measurement was conducted after the influence of diffusion layer had been eliminated.

Electrolysis conditions were; electrolyte composition: NaCl 194.3 g/l, $NaClO_3$235.1 g/l, NaClO 29 g/l, pH: 8.5, temperature: 30° C.

Prepolarization of cathode was conducted in the liquid of above composition at current density of 25 A/dm$^2$, at 30° C. for 72 hours.

After the prepolarization, the potential was derived from current-voltage curve and the cathode current loss was derived from the critical current. The result is shown in Table 7.

TABLE 7

| Exp. No. | Metal of Reduction Inhibiting Layer | Metal Salt | Solvent | Cathode Current Loss (%) | Cathode Potential V(SCE) |
|---|---|---|---|---|---|
| 22 | Calcium | $CaCl_2$ | DMF + aniseed oil | 0.7 | −1.28 |
| 23 | Magnesium | $MgCl_2$ | " | 2.4 | −1.25 |
| 24 | Strontium | $Sr(OH)_2 . 8H_2O$ | $H_2O$ + DMF | 1.5 | −1.14 |
| 25 | Barium | $BaCl_2 . 2H_2O$ | " | 3.1 | −1.23 |
| 26 | Zinc | $ZnCl_2$ | DMF | 5.6 | −1.17 |
| 27 | Chromium | $CrO_3$ | 2-ethyl hexanol | 2.3 | −1.15 |
| 28 | Molybdenum | $MoCl_5$ | DMF | 4.3 | −1.20 |
| 29 | Tungsten | $WCl_6$ | " | 3.6 | −1.19 |
| 30 | Selenium | $H_2SeO_3$ | " | 4.7 | −1.21 |
| 31 | Tellurium | $TeO_3$ | HCl + $H_2O$ + DMF | 4.5 | −1.23 |
| 32 | Activated layer only | | | 9.9 | −1.16 |
| 33 | Iron cathode (electrolytic bath $Na_2Cr_2O_7$, 2 g/l added) | | | 1.8 | −1.48 |
| 34 | Iron cathode (no addition) | | | 17.1 | −1.34 |

In the Table 7, the experiment numbers 22–31 show the examples in accordance with the present invention while the experiment numbers 32–34 show the comparative examples.

The measurement was conducted at the current density of 20 A/dm$^2$. It is seen from the Table 7 that the cathodes of the present invention show the effect of prevention of $ClO^-$ reduction to substantially same degree as or somewhat larger degree than the prior art method, and show the cathode potential which is 0.20–0.34 V higher than the prior art method. Thus, the electrolytic cell voltage decreases correspondingly, which in turn leads to enhancement in economization, in addition to the prevention of chromium contamination.

EXAMPLE 7

After dipping the electrodes of the Example 6 in 35% HCl aqueous solution for one day and night, they were measured under the same conditions. The result is shown in Table 8.

It is seen from the Table 8 that they show sufficiently high corrosion resistances.

TABLE 8

| Metal of Reduction Inhibiting Layer | Cathode Current Loss (%) | Cathode Potential V (SCE)** |
|---|---|---|
| Calcium | 0.9 | −1.30 |
| Strontium | 1.4 | −1.16 |
| Barium | 4.5 | −1.19 |

**Potential difference from saturated colomel reference electrode.

EXAMPLE 8

Examples of using two or more metal oxides as the reduction inhibiting layer as well as using integrated layer of the activated layer and the reduction inhibiting layer are shown. The manufacturing method thereof is in accordance with the method in the Example 6.

The result is shown in Table 9. The measurement was conducted at the cathode current density of 20 A/dm$^2$.

Experiment Nos. 35–39 and 43–47 show two-layer deposition, and 40–42 and 48–50 show single-layer deposition. While the single layer deposition shows slight increase of the cathode current loss, it is still in allowable range from industrial standpoint.

TABLE 9

| Exp. No. | Metal of Activated Layer | Metal of Reduction Inhibiting Layer | Cathode Current Loss % | Cathode Potential V (SCE)** |
|---|---|---|---|---|
| 35 | Ru + Rh | Ca + Mg | 1.0 | −1.32 |
| 36 | " | Ca + Sr | 0.9 | −1.31 |
| 37 | " | Sr + Ba | 2.1 | −1.24 |
| 38 | " | Ca + Cr | 1.7 | −1.29 |
| 39 | " | Sr + Mo | 3.4 | −1.22 |
| 40 | Ru + Rh + Ca | | 2.6 | −1.27 |
| 41 | Ru + Rh + Ca + Sr | | 2.5 | −1.30 |
| 42 | Ru + Rh + Cr + Sr | | 3.3 | −1.19 |
| 43 | Ru + Rh | Cr + Mo | 3.7 | −1.21 |
| 44 | " | Cr + W | 2.0 | −1.23 |
| 45 | " | Mo + W | 3.2 | −1.21 |
| 46 | " | Cr + Se | 5.1 | −1.18 |
| 47 | " | Cr + Te | 4.5 | −1.18 |
| 48 | Ru + Rh + Cr (1:1:2) | | 4.3 | −1.19 |
| 49 | Ru + Rh + Mo (1:1:2) | | 6.2 | −1.17 |
| 50 | Ru + Rh + Cr + W (1:1:2:2) | | 3.8 | −1.20 |

**Potential difference from saturated colomel reference electrode.

In the Table 9, unless otherwise specified, the mixing ratio of metal oxides is 1:1:1 or 1:1:1:1 when represented by equivalent metal gr.atom ratio.

EXAMPLE 9

1. Manufacture of cathode

Using a titanium plate of 50 mm×50 mm (0.25 dm$^2$)×3 mm thickness, Ru-Rh and Cr oxide layer was deposited on one surface of the titanium plate in accordance with the method of 1. in the Example 1, and Ru-Rh-Sb (equivalent metal gr.atom ratio of 2:1:1) mixed oxide layer was formed on the opposite surface as an anode surface simultaneously with the formation of the cathode surface to complete a composite electrode. The anode surface was prepared under the same conditions of etching, deposition and heating as those for the cathode surface except that the metal salt solution was prepared by dissolving $RuCl_3.3H_2O$ and $RhCl_3.3H_2O$ in DMF and diluting $SbCl_3$ with 2-ethylhexanol and mixing the both solutions.

Seven such composite electrodes and a pair of monoelectrodes (cathode and anode) were combined to construct a composite electrode type electrolytic cell.

2. Using the above electrolytic cell, sodium chlorate was manufactured.

The electrolysis conditions were; electrolyte composition: NaCl 186–203 g/l, $NaClO_3$ 239–251 g/l, NaClO 2.3–2.7 g/l, pH: 6.2–6.6, temperature: 45° C., current: 6.3 A (25 A/dm$^2$), interelectrode gap: 3 mm, and under a continuous operation. The result is shown in Table 10.

TABLE 10

| Number of Days after Activation | Cathode Current Loss (%) | Cathode Current Loss after Washing by HCl Aqueous Solution (%) | Voltage per Cell (V) |
|---|---|---|---|
| 0 | 2.9 | — | 2.75 |
| 6 | 2.5 | — | 2.84 |
| 13 | 2.1 | 3.5 | 2.87 |
| 29 | 2.4 | 3.1 | 2.96 |
| 57 | 1.9 | — | 2.94 |

It is observed from the above experiment that;

(i) although the cathode current loss is substantially equal to that in a prior art method, the voltage is 0.2–0.25 V lower than the prior art and hence the amount of power required for production of the product of 800–1000 KWH/$NaClO_3$ ton can be saved, (ii) the effect of the prevention of $ClO^-$ reduction does not decrease even after 57-day operation, and (iii) the cause of voltage rise with the elapse of time is the deposition of scale on the cathode.

3. Using the electrolytic cell of 1. above, electrolytic preparation of sodium hypochlorite was effected.

The electrolysis conditions were; electrolyte composition: NaCl 115 g/l, effective chlorine (free chlorine) 9 g/l, pH: 7.8, temperature: 20° C., current: 5 A (20 A/dm$^2$), interelectrode gap: 3 mm, and operation was continued for 7 days.

The results were; average cathode current loss of 5.8%, current efficiency of 73%, voltage of 3.61 V and amount of D.C. power required for production of the product of 3750 KWH/free $Cl_2$ ton.

EXAMPLE 10

The method of 1. in the Example 9 was repeated except that Ru-Rh oxide layer as the activated layer and Ca oxide layer as the $ClO^-$ reduction inhibiting layer were prepared in accordance with the method of the Example 6. The composite electrodes thus manufactured were constructed into an electrolytic cell in the same way as in 1 of the Example 9. Using the above electrolytic cell, the electrolytic preparation of sodium hypochlorite was conducted.

The electrolysis conditions were; electrolyte composition: NaCl 115 g/l, effective chlorine (free chlorine) 7.8 g/l, pH: 8.0, temperature: 20° C., current 5 A (20 A/dm$^2$), interelectrode gap: 3 mm.

Average cathode current loss in 11-day continuous operation was 4.5%, with current efficiency of 75%, voltage of 3.66 V and amount of D.C. required for production of the product of 3700 KWH/free $Cl_2$ ton.

What is claimed is:

1. An electrolytic cell comprising an activated cathode, an anode and an aqueous solution of an electrolyte, said activated cathode comprising:

(a) a base plate selected from the group consisting of titanium, tantalum, zirconium, niobium and an alloy essentially consisting of a combination of those metals;

(b) an activated layer of at least one metal oxide selected from the group consisting of oxides of a metal element selected from the group consisting of ruthenium, rhodium, palladium, osmium, iridium and platinum, formed on the surface of the base plate (a); and (c) a reduction inhibiting layer of at least one other oxide selected from the group consisting of oxides of an element selected from the group consisting of magnesium, calcium, strontium, barium, zinc, selenium, tellurium, chromium, molybdenum and tungsten formed on the surface of the activated layer of metal oxide (b).

2. An electrolytic cell according to claim 1 wherein in the activated cathode the thicknesses of the activated layer (b) and the reduction inhibiting layer (c) are 0.5–50 microns.

3. An electrolytic cell according to claim 1 wherein in the activated cathode the base plate is titanium.

4. An electrolytic cell according to claim 1 wherein in the activated cathode layer (b) consists of said metal oxide or oxides and layer (c) consists of said oxide or oxides.

5. An electrolytic cell according to claim 1 wherein in the activated cathode the base plate is titanium.

6. An electrolytic cell according to claim 1 wherein in the cathode layer (b) consists of said oxide or oxides.

7. An electrolytic cell according to claim 1 wherein in the activated cathode the shape thereof is in the form of a:

(i) plate, (ii) sheet, (iii) plate or sheet having number of apertures formed therein, (iv) mesh or expanded metal, (v) grille or (vi) a box-type or cylindrical body including mesh, grille or punched metal which is welded to plate, pipe, rod or rib.

8. An electrolytic cell according to claim 1 wherein in the activated cathode the thickness of the activated layer (b) is 0.5–50 microns.

9. An activated cathode for use in the aqueous solution electrolysis comprising:

(a) a base plate selected from the group consisting of titanium, tantalum, zirconium, niobium and an alloy essentially consisting of a combination of those metals;

(b) an activated layer of at least one metal oxide selected from the group consisting of oxides of a metal element selected from the group consising of ruthenium, rhodium, palladium, osmium, iridium and platinum, formed on the surface of the base plate; and (c) a reduction inhibiting layer of at least one other oxide selected from the group consisting of oxides of an element selected from the group consisting of magnesium, calcium, strontium, barium, zinc, selenium, tellurium, chromiun, molybdenum and tungsten formed on the surface of the activated layer of metal oxide (b).

10. An activated cathode according to claim 9 wherein the thicknesses of the activated layer (b) and the reduction inhibiting layer (c) are 5–50 microns.

11. An activated cathode according to claim 9 wherein the base plate is titanium.

12. An activated cathode according to claim 9 wherein layer (b) consists of said metal oxide or oxides and layer (c) consists of said oxide or oxides.

* * * * *